US007664414B2

(12) United States Patent
Ueda et al.

(10) Patent No.: US 7,664,414 B2
(45) Date of Patent: Feb. 16, 2010

(54) LIQUID DEVELOPING DEVICE AND WET IMAGE FORMING DEVICE

(75) Inventors: Hiroyuki Ueda, Osaka (JP); Koji Murase, Hyogo (JP); Tomoyuki Oda, Kyoto (JP); Hidenori Takenaka, Osaka (JP); Nobuhiro Horiuchi, Nara (JP); Jumpei Hobo, Osaka (JP)

(73) Assignee: Kyocera Mita Corporation (JP)

( * ) Notice: Subject to any disclaimer, the term of this patent is extended or adjusted under 35 U.S.C. 154(b) by 484 days.

(21) Appl. No.: 11/727,364

(22) Filed: Mar. 26, 2007

(65) Prior Publication Data

US 2007/0223950 A1 Sep. 27, 2007

(30) Foreign Application Priority Data

Mar. 27, 2006 (JP) ..... 2006-086439

(51) Int. Cl.
*G03G 15/10* (2006.01)

(52) U.S. Cl. ..... 399/58; 399/62

(58) Field of Classification Search ..... 399/38, 399/53, 57, 58, 59, 61, 62, 233, 237
See application file for complete search history.

(56) References Cited

U.S. PATENT DOCUMENTS 5,983,047 A * 11/1999 Lee ..... 399/57
6,542,704 B2 * 4/2003 Suetsugu ..... 399/57
6,819,887 B1 * 11/2004 Kim et al. ..... 399/57

FOREIGN PATENT DOCUMENTS

JP 2001-305867 A 11/2001

* cited by examiner

*Primary Examiner*—Hoan H Tran
(74) *Attorney, Agent, or Firm*—Ostrolenk Faber LLP

(57) ABSTRACT

When the temperature of the liquid toner has fluctuated by T1 or more (Step S3: YES), the equation obtained by measuring the liquid toner is modified (Steps S4 through S7). This equation is obtained based on the output voltage value of the concentrated toner liquid sensor 27, which has the same specifications as those of the liquid toner sensor 24, and the output voltage value of the carrier liquid sensor 29, which has the same specifications as those of the liquid toner sensor 24 (S4 through S6). The output voltage value of the liquid toner sensor 24 is entered into the modified equation to calculate the toner solids content of the liquid toner of the storage tank 18 (Step S8). Control of the concentration of the liquid toner is carried out based on the calculated toner solids content (Step S9).

4 Claims, 4 Drawing Sheets

LIQUID DEVELOPING DEVICE AND WET IMAGE FORMING DEVICE

CROSS-REFERENCE TO RELATED APPLICATIONS

This application claims priority to Japanese Patent Application No. 2006-086439 filed on Mar. 27, 2006. The entire disclosure of Japanese Patent Application No. 2006-086439 is hereby incorporated herein by reference.

BACKGROUND OF THE INVENTION

1. Field of the Invention

The present invention generally relates to a liquid developing device. More specifically, the present invention relates to a liquid developing device that develops electrostatic latent images using liquid toner, and to a wet image forming device that includes the liquid developing device.

2. Background Information

Usually, image forming devices based on electrophotography, electrostatic latent images on a photosensitive drum are developed using powder toner. However, liquid developing devices in which electrostatic latent images are developed using liquid toner that is concentrated toner liquid diluted with carrier liquid have been proposed as seen in, for example, Japanese Patent Application Laid-open No. 2001-305867.

A liquid toner storage tank that stores liquid toner to be applied to the photosensitive drum is respectively supplied with concentrated toner liquid and carrier liquid from a toner liquid cartridge and a carrier cartridge. The concentrated toner liquid and carrier liquid are mixed and stored in the liquid toner storage tank. In order to obtain high quality images in an image forming device, it is necessary to maintain appropriately the toner solids content (toner powder as a percentage of the liquid toner) of the liquid toner in the liquid toner storage tank. Therefore the toner solids content of the liquid toner is constantly measured, and based on the measured value, the supplied quantity of concentrated toner liquid or carrier liquid is adjusted. The toner solids content is measured using for example an optical sensor.

In the developing device according to Japanese Patent Application Laid-open No. 2001-305867, the light emitting element and the light receiving element of the optical sensor are disposed mutually in opposition and positioned to sandwich the liquid toner. The toner solids content is measured based on, for example, the output current value of the light receiving element.

In this measurement method, an equation that expresses the relationship between the output value of the optical sensor and the toner solids content of the liquid toner is obtained in advance. The output value of the optical sensor obtained by measuring the liquid toner is entered into the equation that has been obtained in advance, to calculate the toner solids content of the liquid toner.

However, strictly speaking, the properties of the concentrated toner liquid in the toner liquid cartridges varies with each cartridge. Also, the properties of the carrier liquid in the carrier cartridges varies with each cartridge. Therefore, when these cartridges are changed, the electrical conductivity and the optical transmittance of the liquid toner varies. Therefore, in the conventional method that uses an equation, there is the possibility that the toner solids content of the liquid toner cannot be accurately measured. If the toner solids content cannot be accurately measured, the concentration of the liquid toner supplied to the photosensitive drum cannot be appropriately maintained, and it is not possible to obtain good images stably.

In view of the above, it will be apparent to those skilled in the art from this disclosure that there exists a need for an improved liquid developing device and wet image forming device. This invention addresses this need in the art as well as other needs, which will become apparent to those skilled in the art from this disclosure.

SUMMARY OF THE INVENTION

Based on this background, it is an object of the present invention to provide a liquid developing device capable of measuring with high accuracy the toner solids content of liquid toner, and appropriately maintaining the concentration of liquid toner supplied to the photosensitive drum.

Also, another object of the present invention is to provide a wet image forming device for which it is possible to stably obtain good images.

A liquid developing device according to a first aspect of the present invention develops electrostatic latent images using liquid toner that includes toner particles dispersed in a carrier liquid. The liquid developing device includes a liquid toner storage tank, a toner liquid cartridge, a carrier cartridge, a liquid toner measurement unit, a carrier liquid measurement unit, an equation determination unit, a toner solids content calculation unit, and a concentration control unit. The liquid toner storage tank stores liquid toner that is supplied to a photosensitive drum. The toner liquid cartridge houses toner liquid with a predetermined toner solids content that is supplied to the liquid toner storage tank. The carrier cartridge houses carrier liquid that is supplied to the liquid toner storage tank. The liquid toner measurement unit measures the liquid toner stored in the liquid toner storage tank, and outputs an output value corresponding to the toner solids content of the liquid toner. The toner liquid measurement unit includes a sensor having the same specifications as those of the liquid toner measurement unit. The toner liquid measurement unit measures the toner liquid supplied from the toner liquid cartridge, and outputs an output value corresponding to the toner solids content of the toner liquid. The carrier liquid measurement unit includes a sensor having the same specifications as those of the liquid toner measurement unit. The carrier liquid measurement unit measures the carrier liquid supplied from the carrier cartridge, and outputs an output value corresponding to the toner solids content of the carrier liquid. The equation determination unit obtains an equation expressing the relationship between the output value of the sensor of the liquid toner measurement unit and the toner solids content of the liquid toner, based on the output values of the toner liquid measurement unit and the carrier liquid measurement unit. The toner solids content calculation unit calculates the toner solids content of the liquid toner in the liquid toner storage tank with reference to the equation determined by the equation determination unit, and based on the output value of the liquid toner measurement unit. The concentration control unit controls the concentration of the liquid toner based on the toner solids content of the liquid toner in the liquid toner storage tank calculated by the toner solids content calculation unit.

A liquid developing device according to a second aspect of the present invention is the device of the first aspect, further including a temperature measurement unit that measures the temperature of the liquid toner in the liquid toner storage tank, wherein the equation is modified based on the temperature measured by the temperature measurement unit.

A wet image forming device according to a third aspect of the present invention includes a photosensitive drum, and the liquid developing device according to the first or second aspect that supplies liquid toner to the photosensitive drum.

According to the invention of the first aspect, the toner solids content of the toner liquid is calculated using an equation obtained from measurements on the toner liquid and carrier liquid used in the device, not using an equation prepared in advance. Therefore the toner solids content can be accurately obtained. In this way, it is possible to maintain the proper concentration of liquid toner supplied to the photosensitive drum without being affected by individual differences in the toner liquid and carrier liquid housed in the toner liquid cartridge and carrier cartridge respectively set in the device.

The toner solids content of the toner liquid supplied from the toner liquid cartridge is known in advance. Also, the toner solids content of the carrier liquid supplied from the carrier cartridge is 0%. There is a linear relationship between the sensor output voltage value and the toner solids content of the liquid toner. Therefore the equation can be easily derived from the output value of the toner liquid and the output value of the carrier liquid.

The electrical conductivity of the liquid toner can fluctuate as the temperature fluctuates. However, in the invention according to the second aspect, the equation is modified based on for example the temperature fluctuations of the toner liquid. Therefore, accurate measurement of the toner solids content can be carried out without being affected by fluctuations in the properties of the liquid toner due to temperature fluctuations.

In the invention according to the third aspect, the liquid developing device according to first or second aspect is used. Therefore, liquid toner with the toner solids content maintained at the proper value can be supplied to the photosensitive drum. In this way it is possible to provide a wet image forming device from which good images can be stably obtained.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

The following is a detailed explanation of an embodiment of the present invention with reference to the drawings.

Figure 1:
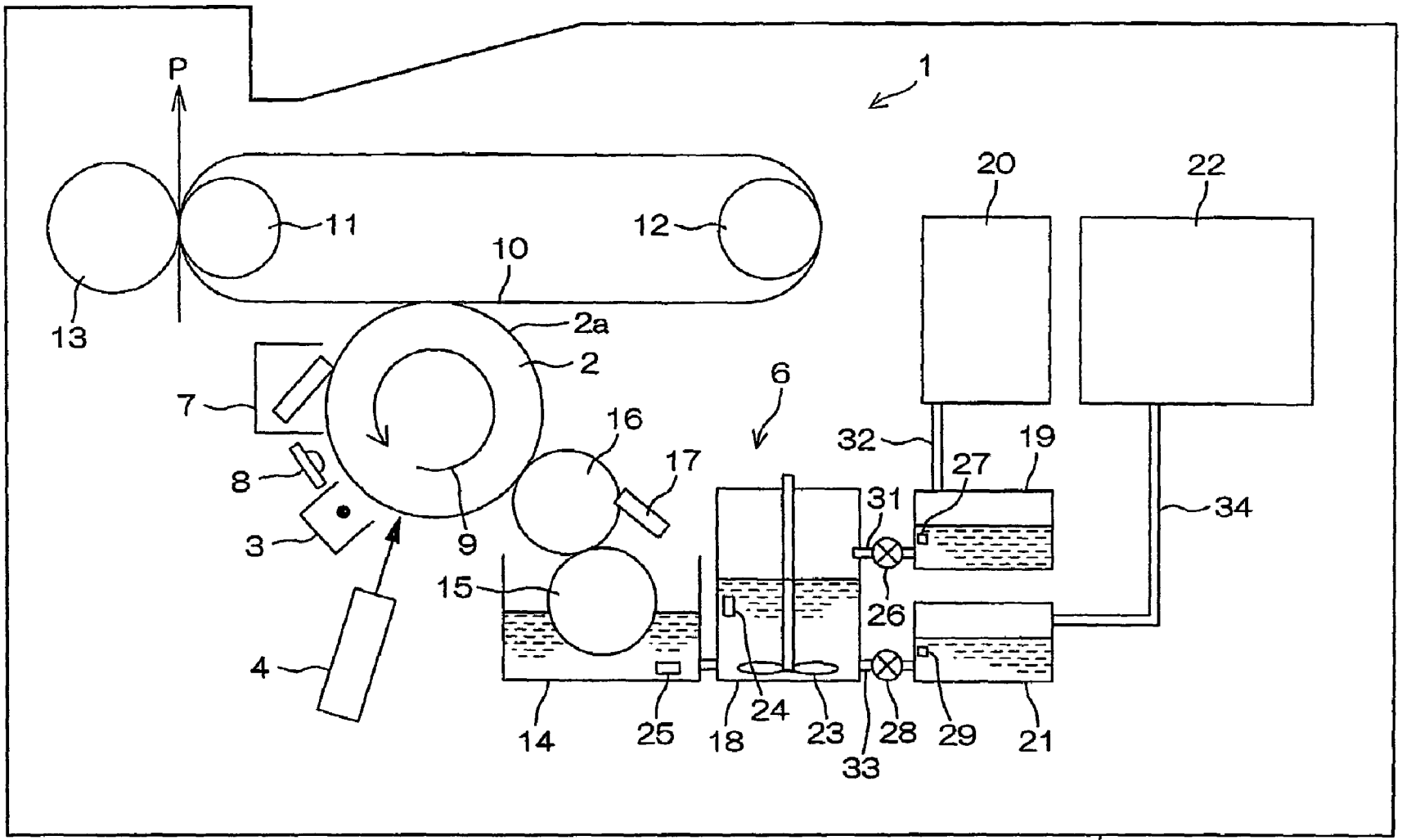
FIG. 1 is a schematic cross-sectional diagrammatic view showing the structure of the main parts of a wet image forming device according to a first preferred embodiment of the present invention.

FIG. 1 is a schematic cross-sectional diagrammatic view showing the structure of an image forming mechanism 1 provided in a wet image forming device 40 according a preferred embodiment of the present invention.

Referring to FIG. 1, the image forming mechanism 1 includes a cylindrical shaped photosensitive drum 2, a charging device 3, a light exposure device 4, a liquid developing device 6, a cleaning device 7, and a decharging device 8. The charging device 3 charges the surface 2*a* of the photosensitive drum 2. The light exposure device 4 exposes the surface 2*a* of the photosensitive drum 2 to light corresponding to the image to be formed. The liquid developing device 6 develops electrostatic latent images formed by the light exposure by supplying liquid toner to the surface 2*a* of the photosensitive drum 2. The cleaning device 7 removes liquid toner remaining on the surface 2*a* of the photosensitive drum 2 after the toner image is transferred to an intermediate transfer belt 10. The decharging device 8 decharges the surface 2*a* of the photosensitive drum 2 after the toner image has been transferred. The charging device 3, the light exposure device 4, the liquid developing device 6, the cleaning device 7, and the decharging device 8 are disposed in that order along the direction of rotation (the direction indicated by the arrow 9) of the photosensitive drum 2.

The image forming mechanism 1 further includes the endless intermediate transfer belt 10, a drive roller 11, and a secondary transfer roller 13. Toner images developed on the surface 2*a* of the photosensitive drum 2 are temporarily transferred to the endless intermediate transfer belt 10. The drive roller 11 drives the intermediate transfer belt 10. The tension roller 12 applies tension force to the intermediate transfer belt 10. The secondary transfer roller 13 transfers toner images temporarily transferred onto the intermediate transfer belt 10 onto sheets P.

The sheets P are transported upwards along a line indicated by the arrow in FIG. 1. When the sheets P pass between the intermediate transfer belt 10 and the secondary transfer roller 13, toner images are transferred to the surface of the sheets P. Heat and pressure are applied to the sheets P to which toner images have been transferred by a fixing device that is not shown in the drawings, which fixes the toner images onto the sheets P.

The liquid developing device 6 includes a developing tank 14 that stores liquid toner, a scoop up roller 15 that scoops up liquid toner from the developing tank 14, and a developing roller 16 that supplies the liquid toner scooped up on the scoop up roller 15 to the surface 2*a* of the photosensitive drum 2. Part of the scoop up roller 15 is dipped into the developing tank 14, and is immersed in the liquid toner within the developing tank 14. The liquid toner stored in the developing tank 14 has very good wetting properties so that the liquid toner is scooped up by the rotation of the scoop up roller 15. A cleaning blade 17 is disposed on the developing roller 16 to remove liquid toner remaining on the surface of the developing roller 16 after forming the image on the surface 2*a* of the photosensitive drum 2. The developing tank 14 is connected to a storage tank 18, which is a liquid toner storage tank. The storage tank 18 stores liquid toner while maintaining the liquid toner at the appropriate concentration (for example, 5.0%). This liquid toner at the appropriate concentration is supplied to the developing tank 14. A temperature sensor (temperature measurement unit) 25 is disposed in the developing tank 14 to measure the temperature of the stored liquid toner.

A toner supply tank 19 is connected to the storage tank 18 via a transport channel 31. The toner supply tank 19 is connected to a toner liquid cartridge 20 via a transport channel 32. The toner liquid cartridge 20 can be inserted into and removed from the liquid developing device 6. The toner liquid cartridge 20 is filled with concentrated toner liquid set to a predetermined toner solids content (for example 30%). A carrier liquid supply tank 21 is connected to the storage tank 18 via a transport channel 33. The carrier liquid supply tank 21 is connected to a carrier cartridge 22 via a transport channel 34. The carrier cartridge 22 is filled with carrier liquid. The toner liquid cartridge 20 and the carrier cartridge 22 can be inserted into and removed from the liquid developing device 6. When either the toner liquid cartridge 20 or the carrier cartridge 22 becomes empty, the cartridge is replaced with a new cartridge respectively filled with concentrated toner liquid or carrier liquid.

A toner agitation blade 23 is provided in the storage tank 18 to agitate the liquid toner. Concentrated toner liquid supplied from the toner liquid cartridge 20 and carrier liquid supplied from the carrier cartridge 22 are agitated by the toner agitation blade 23 and mixed together.

A liquid toner sensor (liquid toner measurement unit) 24 is disposed in the storage tank 18 to measure the toner solids content of the stored liquid toner. As described later, the liquid toner sensor 24 outputs an output voltage. The output voltage value is entered into an equation that expresses the relationship between the sensor output value and the toner solids content of the liquid toner, to calculate the toner solids content of the liquid toner in the storage tank 18. Concentration control is carried out on the liquid toner in the storage tank 18 based on the calculated toner solids content. This concentration control is carried out to maintain the toner solids content of the liquid toner at an appropriate value. In the present embodiment, the liquid toner sensor 24 is disposed in the storage tank 18, however, the liquid toner sensor 24 may be disposed in the developing tank 14.

The toner supply tank 19 temporarily stores concentrated toner liquid from the toner liquid cartridge 20. A toner supply pump 26 is provided on the transport channel 31. When the toner supply pump 26 operates, concentrated toner liquid stored in the toner supply tank 19 is supplied to the storage tank 18. A concentrated toner liquid sensor (toner liquid measurement unit) 27 is disposed in the toner supply tank 19 to measure the toner solids content of the stored concentrated toner liquid. The concentrated toner liquid sensor 27 is a sensor preferably having the same specifications as those of the liquid toner sensor 24.

The carrier liquid supply tank 21 temporarily stores carrier liquid from the carrier cartridge 22. A carrier liquid supply pump 28 is provided on the transport channel 33. When the carrier liquid supply pump 28 operates, carrier liquid stored in the carrier liquid supply tank 21 is supplied to the storage tank 18. A carrier liquid sensor (carrier liquid measurement unit) 29 is disposed in the carrier liquid supply tank 21 to measure the toner solids content of the stored carrier liquid. The carrier liquid sensor 29, as for the concentrated toner liquid sensor 27, is a sensor preferably having the same specifications as those of the liquid toner sensor 24.

A characteristic of the present embodiment is that the equation for calculating the toner solids content of the liquid toner from the output voltage value of the liquid toner sensor 24 is not an equation that is prepared in advance. The equation is obtained from the output value of the concentrated toner liquid sensor 27 and the output value of the carrier liquid sensor 29. In this way, it is possible to measure accurately the toner solids content of the liquid toner, without being affected by the individual differences in the concentrated toner liquid and the carrier liquid.

Also, the toner supply tank 19 is placed between the toner liquid cartridge 20 and the storage tank 18, and the toner solids content of the concentrated toner liquid in the toner supply tank 19 is measured with the concentrated toner liquid sensor 27. Therefore, the toner solids content of the concentrated toner liquid is easily measured. Also, the same can be said of the carrier liquid supply tank 21. The carrier liquid supply tank 21 is placed between the carrier cartridge 22 and the storage tank 18, and the toner solids content of the carrier liquid in the carrier liquid supply tank 21 is measured by the carrier liquid sensor 29. Therefore, the toner solids content of the carrier liquid is easily measured.

Figure 2:
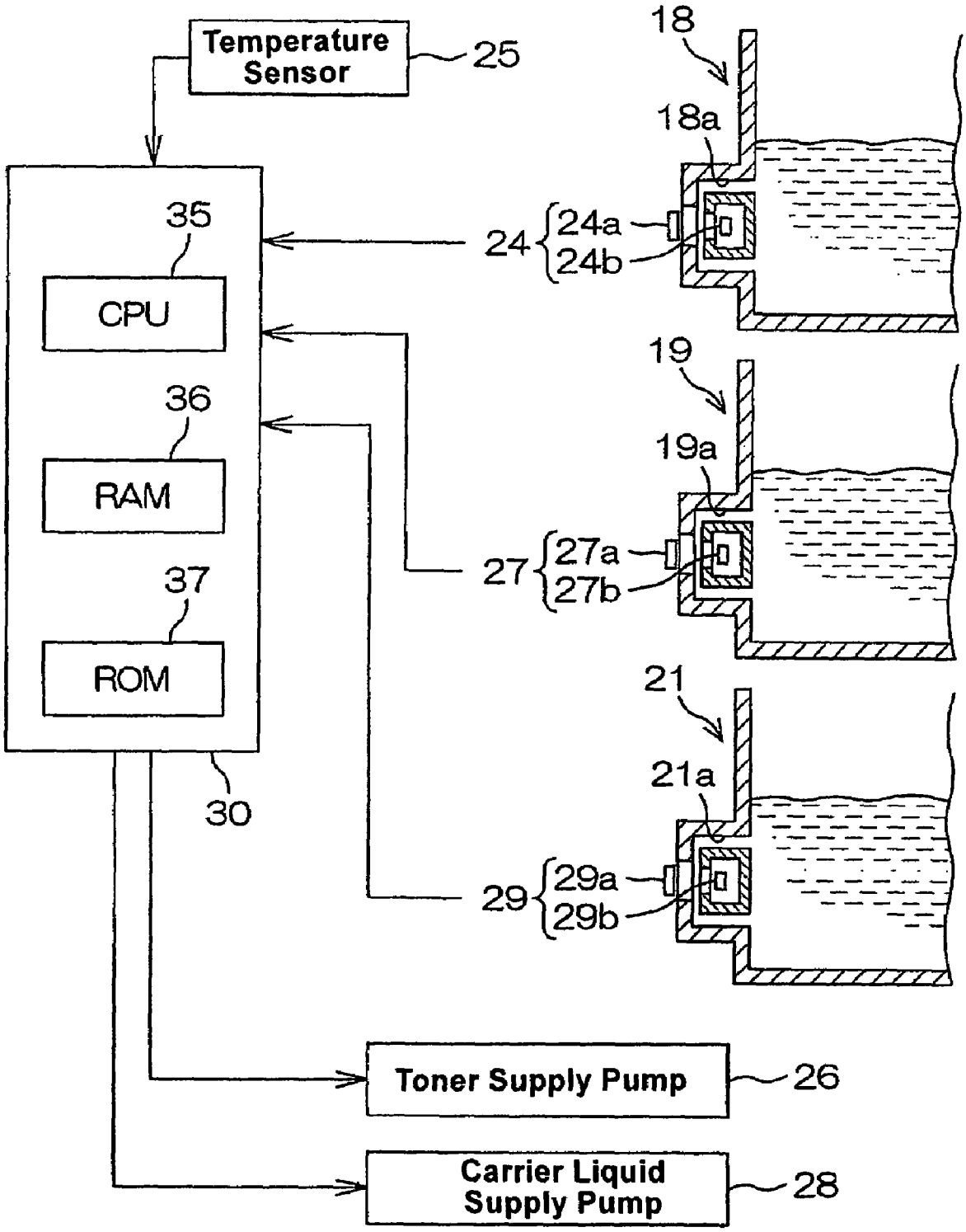
FIG. 2 is a schematic diagrammatic view showing the electrical configuration of a liquid developing device for the wet image forming device.

FIG. 2 is a schematic diagrammatic view showing the electrical configuration of the liquid developing device 6. Referring to FIG. 2, the operation of the developing device 6 is controlled by a control unit 30 that includes a CPU 35, a RAM 36, and a ROM 37. By executing a predetermined program stored in the ROM 37 by the CPU 35, the control unit 30 functions as an equation determination unit, a toner solids content calculation unit, and a concentration control unit. The liquid toner sensor 24, the concentrated toner liquid sensor 27, and the carrier liquid sensor 29 are connected to the control unit 30. The liquid toner sensor 24 disposed in the storage tank 18 is a commonly known transmission type optical sensor, structured to be capable of optically measuring the amount of light transmitted from a light emitting element 24*a* to a light receiving element 24*b*. As shown in FIG. 2, the light emitting element 24*a* and the light receiving element 24*b* of the liquid toner sensor 24 are disposed mutually in opposition in a position that sandwiches a density measurement channel 18*a* formed from the circulation path of the storage tank 18. Light from the light emitting element 24*a* passes through the density measurement channel 18*a* and the liquid toner and arrives at the light receiving element 24*b*. At that time, an output voltage can be measured corresponding to the toner solids content of the liquid toner in the storage tank 18 based on the amount of light received by the light receiving element 24*b*. If the toner solids content of the liquid toner is high, the amount of light received by the light receiving element 24*b* is low, the current is low, and the output voltage is also low. On the other hand, if the toner solids content of the liquid toner is low, the amount of light received by the light receiving element 24*b* is high, the current is high, and the output voltage is also high. The value of the output voltage of the light receiving element 24*b* is input to the control unit 30.

The concentrated toner liquid sensor 27 is disposed in the toner supply tank 19 at a density measurement channel 19*a* formed in the circulation path of the toner supply tank 19. A light emitting element 27*a* and a light receiving element 27*b* of the concentrated toner liquid sensor 27 are disposed mutually in opposition in a position that sandwiches the density measurement channel 19*a* of the toner supply tank 19. The concentrated toner liquid sensor 27 is a sensor with the exact same specification as the liquid toner sensor 24. The value of the output voltage of the light receiving element 27*b* of the concentrated toner liquid sensor 27 is input to the control unit 30.

The carrier liquid sensor 29 is disposed in the carrier liquid supply tank 21 at a density measurement channel 21*a* formed in the circulation path of the carrier liquid supply tank 21. A light emitting element 29*a* and a light receiving element 29*b* of the carrier liquid sensor 29 are disposed mutually in opposition in a position that sandwiches the density measurement channel 21*a* of the carrier liquid supply tank 21. The carrier liquid sensor 29 preferably has the exact same specifications as those of the liquid toner sensor 24. In the optical sensors according to the present embodiment, a sensor with the same specifications means that the diode structure and material are the same as the light receiving element 24*b* of the liquid toner sensor 24. Also, it means that the spacing of the light emitting element and the light receiving element is the same as that of the light emitting element 24*a* and the light receiving element 24*b*. The value of the output voltage of the light receiving element 29*b* of the carrier liquid sensor 29 is input to the control unit 30.

Also, the control unit 30 is connected to the temperature sensor 25 so that the output signal of the temperature sensor 25 is input to the control unit 30. Furthermore, the control unit 30 is connected to the toner supply pump 26 and the carrier liquid pump 28 as objects of control.

The control unit 30 calculates the toner solids content of the liquid toner stored in the storage tank 18 based on the value of output voltage from the liquid toner sensor 24. In addition, the control unit 30 controls the toner supply pump 26 and the carrier liquid pump 28 to maintain the toner solids content at an appropriate value based on the calculated toner solids content.

The equation for calculating the toner solids content of the liquid toner is not set in advance. The control unit 30 derives the equation based on the value of the voltage output from the concentrated toner liquid sensor 27 and the value of the voltage output from the carrier liquid sensor 29. Then the control unit 30 enters the value of the voltage output from the liquid toner sensor 24 into this equation, and calculates the concentration. The control unit 30 is provided separately from the main control unit (not shown on the drawings) of the complete image forming device 40. However, it is also possible to carry out the control by including the control unit 30 within the main control unit.

Figure 3:
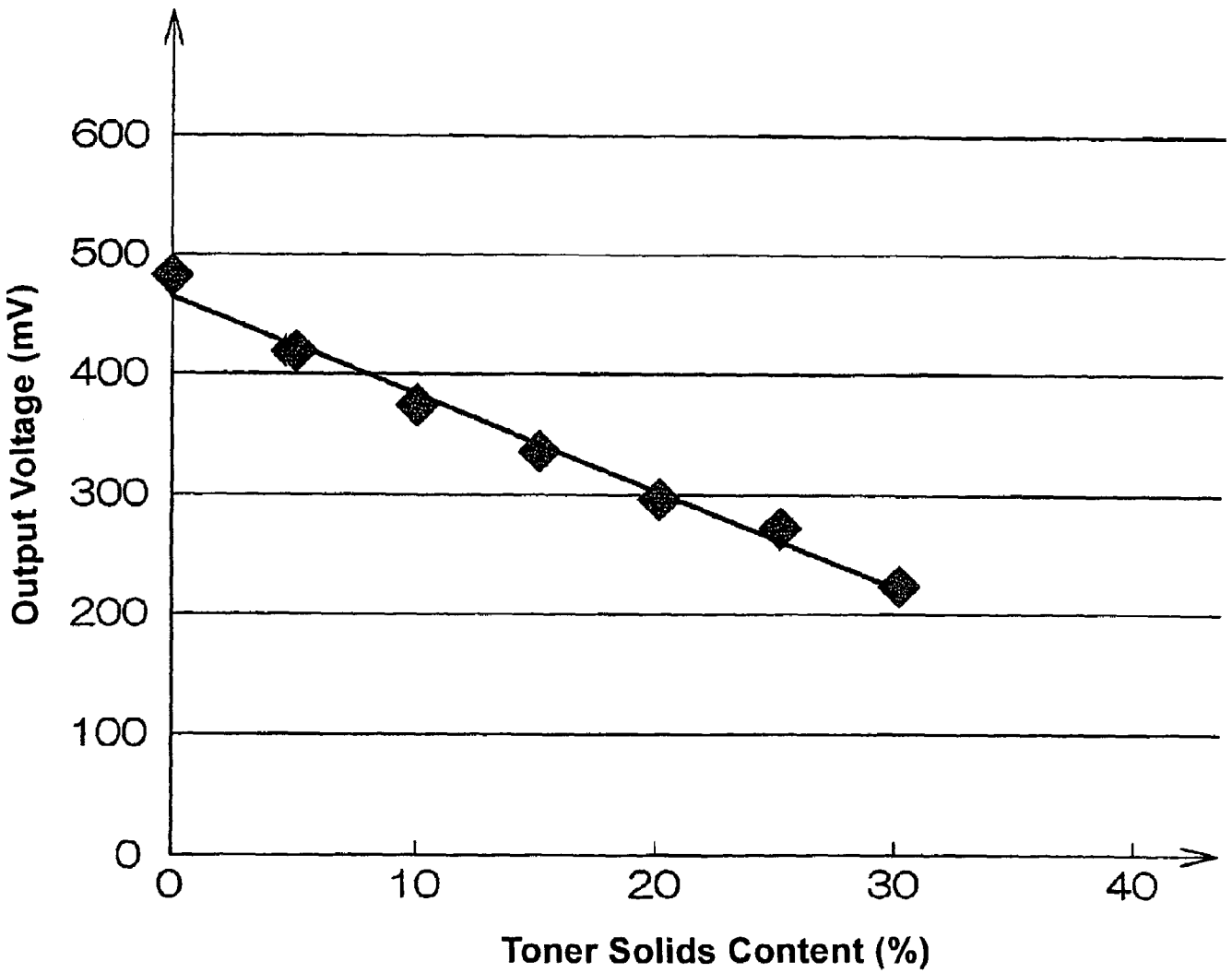
FIG. 3 is a view of a diagram showing the relationship between the toner solids content in the liquid toner and the output voltage value for the wet image forming device.

FIG. 3 is a view of a diagram showing the relationship between the toner solids content in the liquid toner and the output voltage value. The horizontal axis shows toner solids content (%), and the vertical axis shows the sensor output voltage value (mV). Concentrated toner liquid (toner solids content 30%) and carrier liquid (toner solids content 0%) were mixed to create liquid solutions with the concentrations 0% (carrier liquid), 5%, 10%, 15%, 20%, 25%, and 30% (concentrated toner liquid). Then each liquid solution was measured with the liquid toner sensor 24. From FIG. 3 it can be seen that there is a linear relationship between the sensor output voltage value and the toner solids content of the liquid toner. Therefore, it is possible to derive the equation by obtaining the output voltage value at two locations with liquid toner having different toner solids contents in the liquid developing device 6.

The toner solids content of the concentrated toner liquid in the toner supply tank 19 is known in advance. Also, the toner solids content of the carrier liquid supplied from the carrier liquid supply tank 21 is 0%. Therefore, the equation can be easily obtained by obtaining the output voltage value of the concentrated toner liquid sensor 27 and the output voltage value of the carrier liquid sensor 29.

Figure 4:
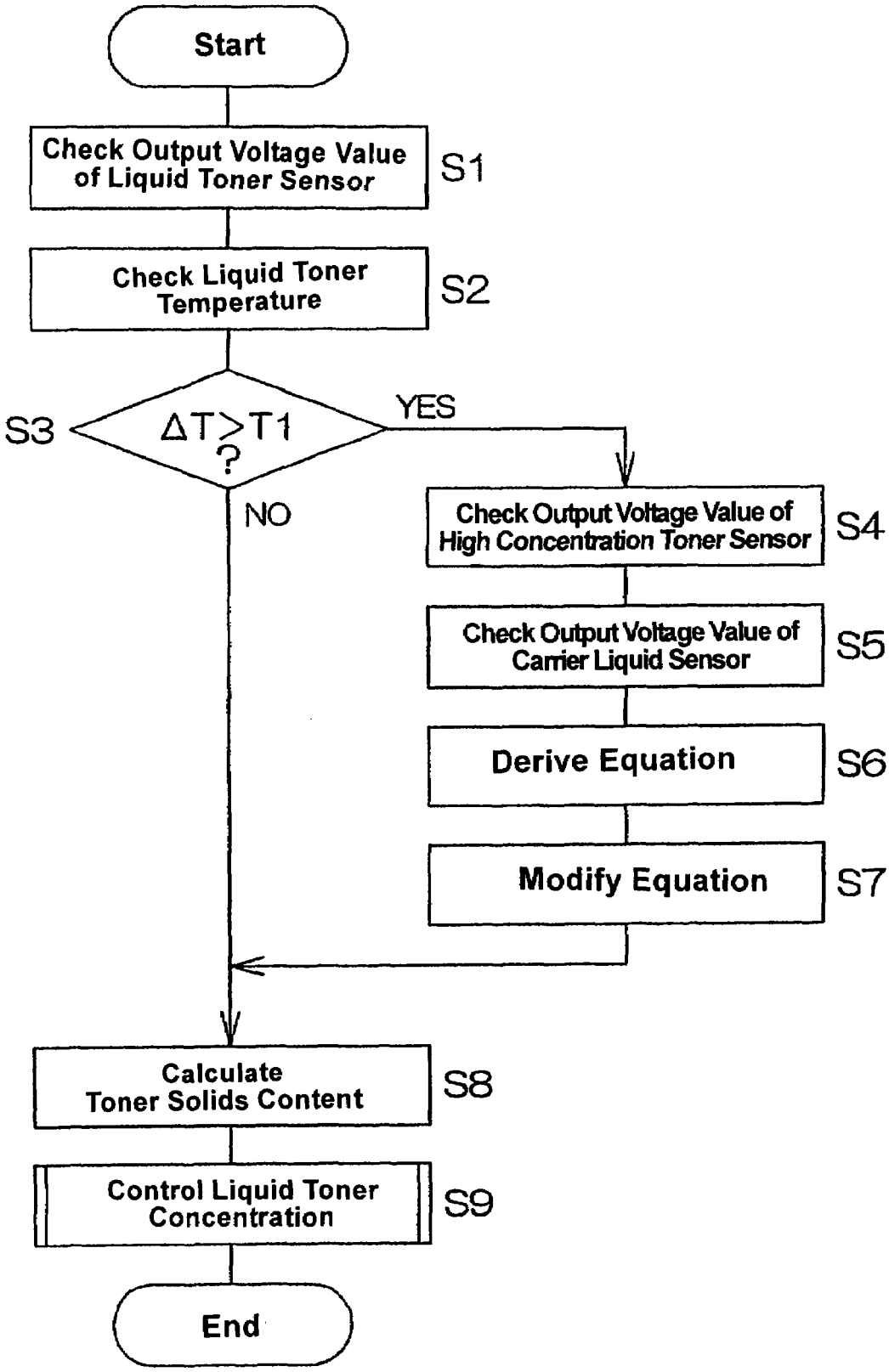
FIG. 4 is a view of a flowchart showing the control of the toner solid content of the liquid toner stored in a storage tank of the liquid developing device.

FIG. 4 is a view of a flowchart showing the control of the toner solids content of the liquid toner stored in the storage tank 18. The following is an explanation of the operation to control the toner solids content of the liquid toner. The control unit 30 measures the toner solids content based on the output voltage value input from the liquid toner sensor 24.

First, the output voltage value of the liquid toner sensor 24 is checked (Step S1). At the same time as checking this output voltage value, the measurement value of the temperature sensor 25 is checked (Step S2).

The temperature of the liquid toner measured by the temperature sensor 25 is compared with the previous measurement, and if the temperature has fluctuated by T1 or more (Step S3: YES), the equation is modified in accordance with the current temperature (Step S4 through S7). The output voltage value of the concentrated toner liquid sensor 27 and the output voltage value of the carrier liquid sensor 29 are checked (Steps S4 and S5), and a new equation is calculated based on these two output voltage values (Step S6).

Then, the equation stored in the RAM 36 is modified to the new equation (Step S7). Then, the toner solids content of the liquid toner is calculated by entering the output voltage value of the liquid toner sensor 24 into the newly obtained equation (Step S8).

On the other hand, if the temperature of the liquid toner measured by the temperature sensor 25 has not fluctuated by T1 or more compared with the previous measurement (Step S3: NO), the equation is not modified. In this case, the toner solids content of the liquid toner is calculated based on the same equation used at the time of the previous measurement that is stored in the RAM 36 (Step S8). In other words, by entering the output voltage value from the liquid toner sensor 24 into the same equation that was used at the time of the previous measurement, the toner solids content of the liquid toner stored in the storage tank 18 is calculated.

The toner supply pump 26 and the carrier liquid supply pump 28 are controlled to maintain the toner solids content of the liquid toner to an appropriate value, based on the toner solids content calculated in Step S8 (Step S9). Specifically, if the calculated toner solids content is equal to or less than an appropriate value, the toner supply pump 26 is operated to supply concentrated toner liquid to the storage tank 18 to increase the toner solids content of the liquid toner in the storage tank 18. Also, if the calculated concentration is equal to or greater than an appropriate value, the carrier liquid supply pump 28 is operated to supply carrier liquid to the storage tank 18 to lower the toner solids content of the liquid toner in the storage tank 18. By repeating these concentration checks, the toner solids content of the liquid toner is maintained at an appropriate concentration.

According to the present embodiment, it is possible to measure accurately the toner solids content of the liquid toner without being affected by fluctuations in the electrical conductivity of the liquid toner that accompany temperature fluctuations of the liquid toner. In this way it is possible to obtain good images stably.

In the above explanation, modification of the equation was carried out based on temperature fluctuations. However, the modification of the equation may be carried out at predetermined time intervals, or modification of the equation may be carried out every time a predetermined number of images have been formed. It is also possible that the properties of the liquid toner may change with time. However, it is possible to measure accurately the toner solids content without being affected by this type of change with time.

The present invention is not limited to the embodiment explained above.

In the above explanation, a voltage value was output from the liquid toner sensor 24, however, the photoelectric current of the light receiving sensor 24*b* may be measured, and a current value may be output.

Also, it has been explained that concentrated toner liquid is housed in the toner liquid cartridge 20, and by measuring this concentrated toner liquid the equation is calculated. However, if the liquid toner is also adjusted in the storage tank 18 using toner recovered after developing, the toner liquid supplied to the storage tank 18 (the toner liquid housed in the toner liquid cartridge 20) may be not concentrated toner liquid (for example 30%) with a high toner solids content, but toner liquid with a toner solids content lower than the appropriate concentration (for example 5%).

Furthermore, the example in which the liquid toner sensor 24 is an optical sensor has been explained. However, the present invention is not limited to this, and other types of sensors may be used. For example, the electric current between a pair of electrodes may be measured.

In addition, many modifications within the scope of the claims are possible.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers, and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming device equipped with the present invention. Accordingly, these terms, as utilized to describe the present invention should be interpreted relative to an image forming device equipped with the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid developing device configured to develop electrostatic latent images using liquid toner including toner particles dispersed in a carrier liquid, comprising:

a liquid toner storage tank being configured to store liquid toner being configured to be supplied to a photosensitive drum;

a toner liquid cartridge being configured to house toner liquid with a predetermined toner solids content supplied to the liquid toner storage tank;

a carrier cartridge being configured to house carrier liquid supplied to the liquid toner storage tank;

a liquid toner measurement unit being configured to measure the liquid toner stored in the liquid toner storage tank, and to output an output value corresponding to the toner solids content of the liquid toner;

a toner liquid measurement unit being configured to include a sensor having the same specifications as those of the liquid toner measurement unit, the toner liquid measurement unit measuring the toner liquid supplied from the toner liquid cartridge, and outputting an output value corresponding to the toner solids content of the toner liquid;

a carrier liquid measurement unit having a sensor having the same specifications as the those of the liquid toner measurement unit, the carrier liquid measurement unit measuring the carrier liquid supplied from the carrier cartridge, and outputting an output value corresponding to the toner solids content of the carrier liquid;

an equation determination unit being configured to obtain an equation expressing the relationship between the output value of the sensor of the liquid toner measurement unit and the toner solids content of the liquid toner based on the output values of the toner liquid measurement unit and the carrier liquid measurement unit;

a toner solids content calculation unit being configured to calculate the toner solids content of the liquid toner in the liquid toner storage tank with reference to the equation determined by the equation determination unit based on the output value of the liquid toner measurement unit; and a concentration control unit being configured to control the concentration of the liquid toner based on the toner solids content of the liquid toner in the liquid toner storage tank calculated by the toner solids content calculation unit.

2. The liquid developing device according to claim 1, further comprising a developing tank configured to receive liquid toner from the liquid toner storage tank, the developing tank having a temperature measurement unit that measures the temperature of the liquid toner in the liquid toner storage tank, wherein the equation is modified based on the temperature measured by the temperature measurement unit.

3. A wet image forming device, comprising:

a photosensitive drum; and a liquid developing device being configured to supply liquid toner to the photosensitive drum, the liquid developing device having a liquid toner storage tank being configured to store liquid toner being configured to be supplied to a photosensitive drum, a toner liquid cartridge being configured to house toner liquid with a predetermined toner solids content supplied to the liquid toner storage tank, a carrier cartridge being configured to house carrier liquid supplied to the liquid toner storage tank, a liquid toner measurement unit being configured to measure the liquid toner stored in the liquid toner storage tank, and to output an output value corresponding to the toner solids content of the liquid toner, a toner liquid measurement unit being configured to include a sensor having the same specifications as those of the liquid toner measurement unit, the toner liquid measurement unit measuring the toner liquid supplied from the toner liquid cartridge, and outputting an output value corresponding to the toner solids content of the toner liquid, a carrier liquid measurement unit having a sensor having the same specifications as the those of the liquid toner measurement unit, the carrier liquid measurement unit measuring the carrier liquid supplied from the carrier cartridge, and outputting an output value corresponding to the toner solids content of the carrier liquid, an equation determination unit being configured to obtain an equation expressing the relationship between the output value of the sensor of the liquid toner measurement unit and the toner solids content of the liquid toner based on the output values of the toner liquid measurement unit and the carrier liquid measurement unit, a toner solids content calculation unit being configured to calculate the toner solids content of the liquid toner in the liquid toner storage tank with reference to the equation determined by the equation determination unit based on the output value of the liquid toner measurement unit, and a concentration control unit being configured to control the concentration of the liquid toner based on the toner solids content of the liquid toner in the liquid toner storage tank calculated by the toner solids content calculation unit.

4. The wet image forming device according to claim 3, wherein the liquid developing device further includes a developing tank configured to receive liquid toner from the liquid toner storage tank, the developing tank having a temperature measurement unit that measures the temperature of the liquid toner in the liquid toner storage tank, wherein the equation is modified based on the temperature measured by the temperature measurement unit.

* * * * *